US008667707B2

(12) United States Patent
Date et al.

(10) Patent No.: US 8,667,707 B2
(45) Date of Patent: Mar. 11, 2014

(54) DEVICE FOR REFRESHING GARMENTS

(75) Inventors: Milind Date, Singapore (SG); Mohankumar Valiyambath Krishnan, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 269 days.

(21) Appl. No.: 13/124,526

(22) PCT Filed: Oct. 6, 2009

(86) PCT No.: PCT/IB2009/054358

§ 371 (c)(1), (2), (4) Date: Apr. 15, 2011

(87) PCT Pub. No.: WO2010/046793

PCT Pub. Date: Apr. 29, 2010

(65) Prior Publication Data

US 2011/0203130 A1 Aug. 25, 2011

(30) Foreign Application Priority Data

Oct. 22, 2008 (EP) ..... 08167207

(51) Int. Cl.
*F26B 21/00* (2006.01)

(52) U.S. Cl.
USPC ..... 34/565; 34/621; 34/104; 34/105; 223/57; 223/70; 68/58; 8/149.3; 211/195

(58) Field of Classification Search
USPC ..... 34/565, 621, 104, 105, 201, 210, 218; 211/85.3, 189, 195; 223/57, 70, 222, 223/235; 68/5 C, 5 R, 18, 19, 20, 58; 8/149.2, 149.3
See application file for complete search history.

(56) References Cited

U.S. PATENT DOCUMENTS

| | | | | | |
|---|---|---|---|---|---|
| 1,570,508 | A | * | 1/1926 | Lungstras | 223/67 |
| 2,338,776 | A | * | 1/1944 | Miller | 223/67 |
| 2,515,828 | A | * | 7/1950 | Jarmain | 34/442 |
| 2,515,848 | A | * | 7/1950 | Winter | 223/67 |
| 3,165,244 | A | * | 1/1965 | Dosal | 223/67 |
| 3,256,617 | A | * | 6/1966 | Konstandt | 34/661 |
| 3,477,621 | A | | 11/1969 | Forse | |
| 3,835,552 | A | * | 9/1974 | Lord | 34/621 |
| 3,929,233 | A | * | 12/1975 | Drace | 223/111 |
| 4,819,812 | A | * | 4/1989 | Demarest, Jr. | 211/1.3 |
| 5,359,786 | A | * | 11/1994 | Vierling | 34/92 |
| 5,361,516 | A | * | 11/1994 | Dahman | 34/440 |
| 5,555,648 | A | | 9/1996 | Griffin | |
| 6,041,517 | A | * | 3/2000 | Wang | 34/439 |

(Continued)

FOREIGN PATENT DOCUMENTS

| | | |
|---|---|---|
| CA | 2176171 | 11/1997 |
| DE | 20218564 | 4/2003 |

(Continued)

*Primary Examiner* — Steve M Gravini

(57) ABSTRACT

A device (1) for refreshing garments comprises means (5) for supporting a garment and means (3) for generating an air flow at the location where a garment is present when it is put in place on the supporting means (5). The supporting means (5) comprise two parts (6, 7) which are both suitable to be used for supporting a garment, and which are displaceably arranged with respect to each other. In this way, an enhanced functionality of the device (1) may be achieved in comparison with a device having supporting means which comprise only a single part.

16 Claims, 3 Drawing Sheets

(56) References Cited

U.S. PATENT DOCUMENTS

| | | | | |
|---|---|---|---|---|
| 6,428,283 | B1 * | 8/2002 | Bonior | 417/201 |
| 6,622,529 | B1 | 9/2003 | Crane | |
| 7,036,670 | B2 * | 5/2006 | Lam | 211/85.3 |
| 7,083,072 | B2 * | 8/2006 | Redlin | 223/67 |
| 7,467,737 | B1 * | 12/2008 | Bissett | 223/85 |
| 7,770,305 | B1 * | 8/2010 | Krauss | 34/60 |
| 8,220,499 | B2 * | 7/2012 | Fukunishi et al. | 139/420 A |
| 2010/0282785 | A1 * | 11/2010 | Roselle et al. | 223/61 |
| 2010/0299952 | A1 * | 12/2010 | Hollinger et al. | 34/201 |
| 2011/0203130 | A1 * | 8/2011 | Date et al. | 34/565 |
| 2013/0118023 | A1 * | 5/2013 | Cennon | 34/202 |

FOREIGN PATENT DOCUMENTS

| | | | |
|---|---|---|---|
| EP | 1528143 | | 5/2005 |
| JP | 04317699 | | 11/1992 |
| JP | 08228851 | | 9/1996 |
| JP | 10230100 | | 9/1998 |
| JP | 2001070696 | A | 3/2001 |
| JP | 2001120899 | A | 5/2001 |
| JP | 2003235712 | | 8/2003 |
| JP | 2003265300 | | 9/2003 |
| JP | 2004344235 | A | 12/2004 |
| WO | 9949123 | | 9/1999 |
| WO | 0250362 | | 6/2002 |
| WO | 2004103127 | | 12/2004 |

* cited by examiner

DEVICE FOR REFRESHING GARMENTS

FIELD OF THE INVENTION

The present invention relates to a device for refreshing garments, comprising means for supporting a garment and means for generating an air flow at the location where a garment is present when it is put in place on the supporting means.

BACKGROUND OF THE INVENTION

It is a well-known fact that when persons visit a bar or a restaurant, their clothes, including their jackets and coats, absorb unpleasant smells like a smell caused by cigarette smoke and/or a smell caused by food odor. Current practice in such cases is to refresh the garments by leaving them hanging in open air overnight. Furthermore, it is a possibility to treat the garments by means of chemical products, as some masking chemical products have been developed in view of the above-sketched problem, which can be sprayed onto soiled garments to reduce the odor.

JP 08-228851 discloses a deodorizing device for clothes in which ozone is used for performing a deodorizing process of the clothes. The device comprises a hollow hanger, wherein a ventilator is provided for sending ozone generated by an ozone generator into the hanger. For the purpose of allowing the hanger to communicate the ozone with the outside, the hanger is provided with small holes. The hanger is intended to be used in combination with a pipe which is also provided with small holes, and which serves for supporting the hanger and for supplying ozone to an inside of the hanger. The pipe is arranged in a locker for enclosing one or more hangers and clothes arranged thereon. During operating of the known deodorizing device, ozone is discharged from the small holes of the pipe and the small holes of the hanger. Consequently, the ozone reacts to odor attached to the inside of clothing supported by the hanger, thereby enabling the odor to be taken away.

SUMMARY OF THE INVENTION

It is an object of the present invention to provide a portable device for refreshing garments, which comprises at least means for supporting a garment and means for generating an air flow at the location where a garment is present when it is put in place on the supporting means, and which is easy to use at the one hand and capable of refreshing garments in an effective and fast way on the other hand. The object is achieved by a device for refreshing garments comprising the supporting means and the air flow generating means as mentioned, wherein the supporting means comprise two parts which are both suitable to be used for supporting a garment, and which are displaceably arranged with respect to each other.

A particular aspect of the device according to the present invention is that the supporting means comprise two parts which are movable with respect to each other. This fact allows for various options in using the device. For example, the parts of the supporting means, which will hereinafter be referred to as supporting parts, may be arranged such as to be displaceable with respect to each other through sliding, wherein the sliding process is performed in a direction which is vertical or close to vertical when the device is in a normal orientation. In that case, the air flow generating means may be arranged in a top supporting part, with a functional side of the air flow generating means, i.e. a side where a blowing or sucking process of air takes place during operation of the air flow generating means, directed at the other supporting part, which is a bottom supporting part. The device according to the present invention offers an improved functionality. For example the impact of the means for generating an air flow or a piece of garment may vary depending on by which part a piece of garment is supported and/or the relative position of both parts for supporting the piece of garment.

When a garment is arranged on the top supporting part, and when the air flow generating means are used to blow air, the air flow is inside out from the garment. However, when the supporting parts are moved apart to such an extent that it is possible to hang a garment from the bottom supporting part, and a garment is actually positioned on the bottom supporting part and the generating means are used to blow air, another functionality is obtained on the basis of the fact that a part of the air flow does not directly flow through the garment. Hence, the air flow is divided in two parts, wherein the first part flows over the garment, at the outside of the garment, while the second part flows through the inside of the garment and from the inside of the garment to the outside.

The device according to the present invention, which comprises the two supporting parts and the air flow generating means, can very well be designed as a portable hanger. In that case, it is advantageous if the device comprises a hook-shaped element for hanging the device. The supporting parts may be adapted to assume a first mutual position in which they are arranged in an abutting fashion, and a second mutual position in which they are arranged at a distance with respect to each other, wherein the device is suitable to be stored when the supporting parts are in the first mutual position. Alternatively, the device can be designed for wall mounting, or may comprise suitable means such as a pedestal or a stand for allowing the device to stand on the ground.

Within the scope of the present invention, many possibilities for allowing a movement of the supporting parts with respect to each other in the device exist, wherein the movement may be a movement which can be performed by hand, which does not alter the fact that an embodiment of the device comprising driving means which can be activated for causing the desired mutual movement (for example, driving means comprising an electrical motor or solenoid based driving means) is also conceivable. In general, the supporting parts may comprise engaging elements which are slideable with respect to each other, and which are adapted to allow for a linear movement of the parts with respect to each other and to guide such movement. For example, the engaging elements may comprise at least one assembly of a shaft and a bush for encompassing and guiding the shaft, wherein each of the shaft and the bush of the assembly is arranged in another of the parts of the supporting means. An advantage of the application of at least one assembly of a shaft and a bush is that a robust structure is obtained, wherein no other means for guiding a displacement of the supporting parts with respect to each other are required.

Feasible alternative mechanisms for allowing a movement of the supporting parts with respect to each other comprise a set of hinged levers, which may be adapted to function as a scissors mechanism, and flexible bellows.

When the device according to the present invention is used to refresh a garment, air is spread throughout the garment by means of the air flow generating means. Means for supplying heat may be provided in the air flow path for increasing the air flow temperature and thereby enhancing the refreshing function. The most preferred option in this case is to have the heating means in an air flow path downstream of the air flow generating means in order to avoid heating of the air flow generating means and possible associated means such as driving means, which may comprise an electrical motor or the like. Furthermore, it is possible for the device according to the present invention to be equipped with any suitable means for performing a refreshing treatment on a garment, including means for supplying steam, means for ionizing air, means for supplying chemical products suitable for treating garments, means for generating ultrasonic sound, and means for adsorbing odor causing molecules. Examples of the latter means are means containing activated carbon or zeolite.

The device according to the present invention may comprise means for controlling its operation. For example, such means may be adapted to control the air flow generating means on the basis of a controlling scheme for letting the air flow generating means perform an air blowing operation during at least one period of time, and letting the air flow generating means perform an air sucking operation during at least one other period of time. However, it is also possible that the controlling means are programmed such as to ensure that the air flow generating means are activated to perform only one of a blowing action and a sucking action in one operation cycle of the device.

In order to have a most effective refreshing operation, it may be advantageous to have an internal air flow in the garment first, and to have an external air flow around the garment later on. This can be achieved by applying the means for controlling the operation of the air flow generating means, namely when the first means are adapted to control the air flow generating means on the basis of a controlling scheme for letting the air flow generating means cause an air flow in a first predetermined area during at least one period of time, and letting the air flow generating means cause an air flow in a second predetermined area, which is another area than the first predetermined area, during at least one other period of time.

Besides various other additional features which are not mentioned here, the device according to the present invention may be provided with a timer for realizing a chosen duration of a garment refreshing process and/or a battery for enabling portable use of the device. More generally speaking, controlling means of the device according to the present invention may be adapted to operate the air flow generating means during a predetermined period of time, and to terminate the operation of the air flow generating means as soon as the end of the predetermined period of time is reached and/or the device may comprise a battery which is adapted for providing the energy which is necessary for operating the device by powering at least the air flow generating means.

It is clearly pointed out in the foregoing that a primary aspect of the device according to the present is the fact that the supporting means comprise two parts which are displaceable with respect to each other. As a consequence of this fact, it is possible to adjust a size of the supporting means as a whole, so that it is possible to use the device for treating garments of various sizes. Also, the device may be made very compact, which allows for easy storage. Garments to be refreshed may be loaded on one of the two supporting parts, depending on the specific requirements of a refreshing treatment to be performed. Hence, according to the present invention, a single device is suitable to be used for performing various treatments. There may even be more possibilities, in particular possibilities associated with various ways in which the air flow generating means and possible other means may be controlled during operation of the device.

As far as the effectiveness of the refreshing process to be performed by means of the device is concerned, it is noted that good results may be obtained on the basis of the fact that there is a simple option for having an air flow both inside the garment and over the garment, at the outside of the garment, if so desired. As has been elucidated in the foregoing, it is possible for one of the supporting parts to hold the air flow generating means, wherein a functional side may be directed at the other of the supporting parts, so that a garment may be treated with both an internal air flow and an external air flow when the supporting parts are displaced such as to be positioned at a distance with respect to each other. By having the two types of air flow, it is possible to not only treat garments which are fully permeable to air, but to treat semi-permeable garments as well. In the case of the two air flows, the external air flow may be a flow at a high rate, whereas the internal air flow may be a flow at a high rate as well, or a flow at a low rate, especially when heating means and/or other means which are useful in odor removing processes are applied. In this respect, it is noted that useful air flow rates may be in a range of about 2-6 cubic meters per minute.

The above-described and other aspects of the present invention will be apparent from and elucidated with reference to the following detailed description of an embodiment of the device according to the present invention.

BRIEF DESCRIPTION OF THE DRAWINGS

The present invention will now be explained in greater detail with reference to the figures, in which equal or similar parts are indicated by the same reference signs, and in which.

DETAILED DESCRIPTION OF EMBODIMENTS

Figure 1:
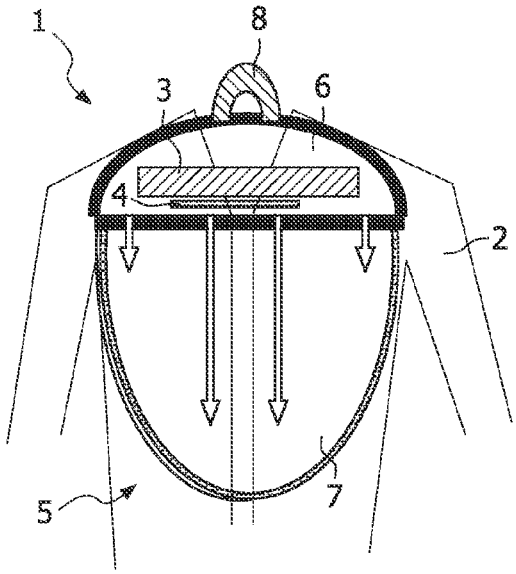
FIG. 1 diagrammatically shows a device according to the present invention and a garment arranged thereon, in a position in which parts of a supporting body of the device are arranged in an abutting fashion.
Figure 2:
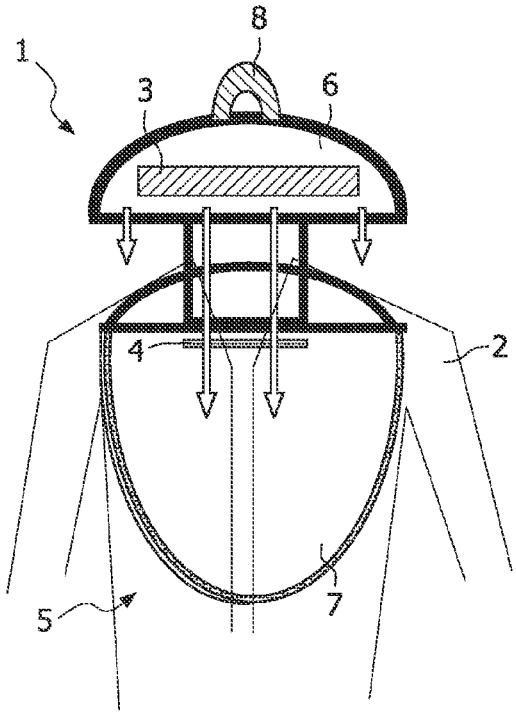
FIG. 2 diagrammatically shows the device according to the present invention and the garment arranged thereon as shown in FIG. 1, in another position, namely a position in which the parts of the supporting body of the device are arranged at a distance with respect to each other.

FIGS. 1 and 2 serve to illustrate a notable principle of the present invention. In the figures, a device 1 for refreshing garments according to the present invention is diagrammatically shown, wherein the position of a garment 2 on the device is indicated by showing a general outline of such a garment 2. The garments refreshing device 1 according to the present invention may be suitable for treating various types of garments 2, including jackets, shirts and blouses.

The garments refreshing device 1 comprises a fan 3 for blowing and/or sucking air in order to create an air flow from the fan 3 to the garment 2 or from the garment 2 to the fan 3, depending on the requirements in a particular case. Controlling means (not shown) of the device 1 may be adapted to let the fan 3 perform at least one air blowing action and at least one air sucking action during a garment refreshing process. Cases may arise in which generating air flows according to alternating forward/reverse schemes adds to the effectiveness of the garment refreshing process. Furthermore, besides the fan 3, the garments refreshing device 1 may comprise a heater 4. When the heater 4 is used, effectiveness of a garment refreshing process may be enhanced or a certain effectiveness may be obtained at a lower flow rate of the air flow.

For the purpose of supporting the garment 2, the garments refreshing device 1 comprises a supporting body 5, which, according to the present invention, comprises two parts 6, 7. Each part is arranged such that it can support a piece of garment. In a normal orientation of the device 1 as shown in FIGS. 1 and 2, one of these parts, which will hereinafter be referred to as top supporting part 6, is positioned on top of the other of these parts 6, 7, which will hereinafter be referred to as bottom supporting part 7.

In the shown example, the fan 3 is arranged in the top supporting part 6, whereas the heater 4 is arranged in the bottom supporting part 7. Furthermore, a hook-shaped element 8 is attached to a top side of the top supporting part 6 for hanging the device 1 from any suitable structure. When the device 1 is hanging, the appearance of the supporting body 5 may be altered by pulling the bottom supporting part 7 in a downward direction with respect to the top supporting part 6, starting from a situation as illustrated in FIG. 1, in which the supporting parts 6, 7 are arranged in an abutting fashion, and the supporting body 5 is a closed whole. In the newly obtained appearance of the supporting body 5, the supporting parts 6, 7 are located at a distance with respect to each other. When it is desired to have the original appearance of the supporting body 5 again, for example for the purpose of treating another garment 2 or storing the device 1, the bottom supporting part 7 may simply be moved back by pushing this supporting part 7 in an upward direction.

It follows from the foregoing that the device 1 according to the present invention comprises a collapsible supporting body 5. On the basis of this fact, the device 1 may be put to a compact position for storing it when it does not need to be used. Furthermore, the device 1 may easily be adapted to the size of a garment 2 to be treated, so that garments 2 of various sizes may be fully supported and refreshed in an effective manner. Another advantageous consequence of using a two-part supporting body 5 is that one and the same fan 3 may be used for only generating an air flow inside a garment 2, or generating air flows both inside and outside a garment 2, as will be explained in the following.

In the position of the supporting parts 6, 7 as shown in FIG. 1, i.e. a position in which the supporting parts 6, 7 are arranged in an abutting fashion, and which will hereinafter be referred to as closed position of the supporting body 5, a garment 2 is arranged on the supporting body 5 by hanging it from the top supporting part 6. Alternatively both parts may be arranged to co-operate and provide a supporting surface of larger dimensions (in comparison with the supporting surface of each part individually). In that case, the fan 3 is at a position inside the garment 2, and the air flow to be generated by means of the fan 3 is inside the garment 2 as well. However, in the position of the supporting parts 6, 7 as shown in FIG. 2, i.e. a position in which the supporting parts 6, 7 are located at a distance with respect to each other, and which will hereinafter be referred to as opened position of the supporting body 5, it is possible to arrange a garment 2 on the supporting body 5 by hanging it from the bottom supporting part 7. In that case, the fan 3 is at a position above the garment 2, and the air flow to be generated by means of the fan 3 has two parts, namely a central part which is inside the garment 2, and an outer part surrounding the central part, which is outside the garment 2. A garment refreshing process in which an air flow is realized both inside a garment 2 and outside a garment 2, wherein the air flow which is at the outside flows over the garment 2, may be especially advantageous in a situation in which the garment 2 is not so much permeable to air, which does not alter the fact that it may also be desirable to realize such a process in other situations.

It is also possible to arrange the fan 3 outside both supporting parts 6, 7 while applying some kind of duct that is connected to either one of such parts. This enables to suck air from a garment irrespective of the arrangement of the device (FIG. 1 or FIG. 2) and the position of the garment.

For sake of completeness, it is noted that a total range of an air flow generated by the fan 3 when being used in a blowing mode is indicated by means of a number of arrows in FIGS. 1 and 2. FIG. 2 shows that the air flow has two parts, namely a part which flows into the garment 2 supported by the bottom supporting part 7, and a part which flows over the garment 2, at the outside of the garment 2.

Figure 3:
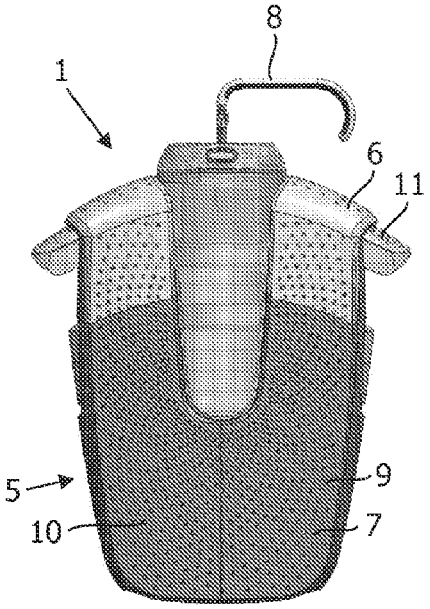
FIG. 3 shows a practical embodiment of the device according to the present invention, in a position in which parts of a supporting body of the device are arranged in an abutting fashion.
Figure 4:
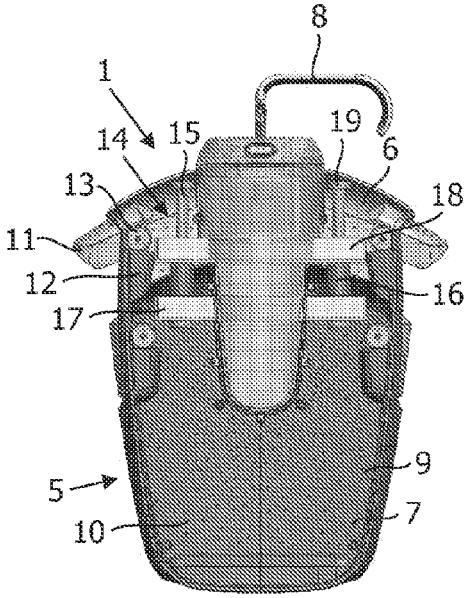
FIG. 4 is similar to FIG. 3, except for the fact that it shows an inside of the supporting body of the device.
Figure 5:
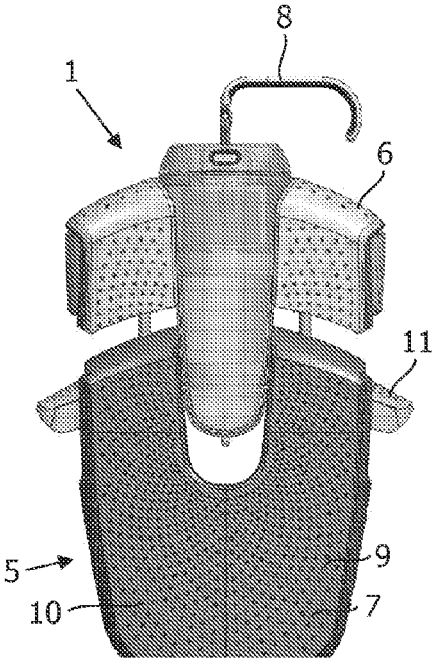
FIG. 5 shows the practical embodiment of the device according to the present invention, in a position in which the parts of the supporting body of the device are arranged in at a distance with respect to each other.
Figure 6:
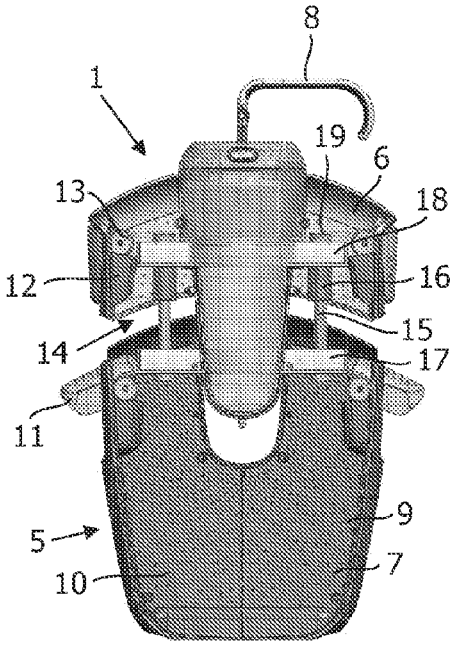
FIG. 6 is similar to FIG. 5, except for the fact that it shows the inside of the supporting body of the device.

FIGS. 3-6 illustrate a practical embodiment of the garments refreshing device 1 according to the present invention. In FIGS. 3 and 4, the supporting body 5 of the device 1 is shown in the closed position, and in FIGS. 5 and 6, the supporting body 5 of the device 1 is shown in the opened position. Furthermore, FIGS. 4 and 6 show the inside of the supporting body 5. The embodiment of the device 1 according to the present invention as illustrated in FIGS. 3-6, which is only one of many possible embodiments existing within the scope of the present invention, will be described in more detail in the following.

In the first place, it is noted that the supporting body 5 has housing shells 9 which are provided with a large number of holes 10 for letting through air from the inside of the supporting body 5 to the outside of the supporting body 5, or the other way around, whatever is appropriate in a certain case.

In the second place, it is noted that extension pieces 11 of a top surface of the supporting parts 6, 7 may be provided, which may be arranged on the supporting body 5 in a detachable manner, so that only one pair of extension pieces 11 is required, as the extension pieces 11 may be arranged on either of the supporting parts 6, 7. Furthermore, the detachable arrangement allows for removal of the extension pieces 11 from the supporting body 5 when it is desired to store the garments refreshing device 1. Inside the supporting parts 6, 7, supports 12 for the extension pieces 11 are arranged, wherein each of these supports 12 comprises a guiding wheel 13 on top in the shown example.

In the third place, it is noted that the supporting parts 6, 7 are slideably connected to each other, wherein two assemblies 14 of a shaft 15 and a bush 16 for encompassing and guiding the shaft 15 are applied. In order to allow for displacement of the supporting parts 6, 7 with respect to each other, the shafts 15 are longer than the bushes 16. In the shown example, ends of the shafts 15 are arranged in a carrier frame 17 having a fixed position in the bottom supporting part 7, whereas the bushes 16 are arranged on a carrier frame 18 having a fixed position in the top supporting part 6. In the closed position of the supporting body 5, the carrier frames 17, 18 are at a distance with respect to each other which resembles a length of the bushes 16, whereas the longer part of the shafts 15 extends inside the top supporting part 6. In the opened position of the supporting body 5, the carrier frames 17, 18 are at a distance with respect to each other which is as long as allowed by a length of the shafts 15. Stops 19 are arranged at the top ends of the shaft 15 in order to prevent the bottom supporting part 7 from getting detached from the top supporting part 6.

Figure 7:
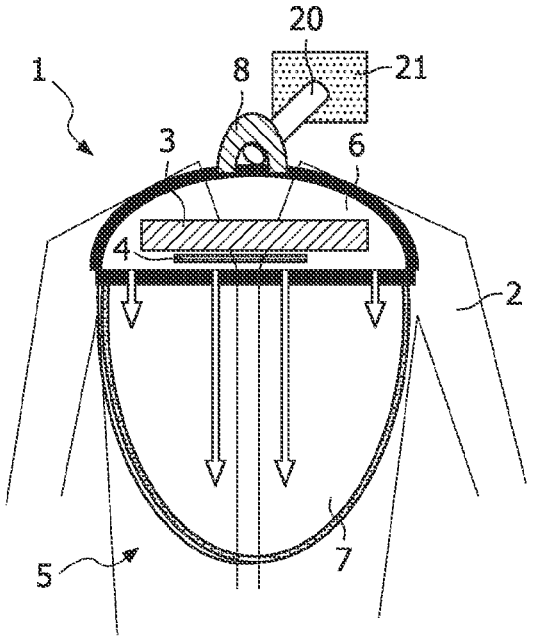
FIG. 7 shows an embodiment of the device according to the present invention which comprises an element for attaching the device to a wall.
Figure 8:
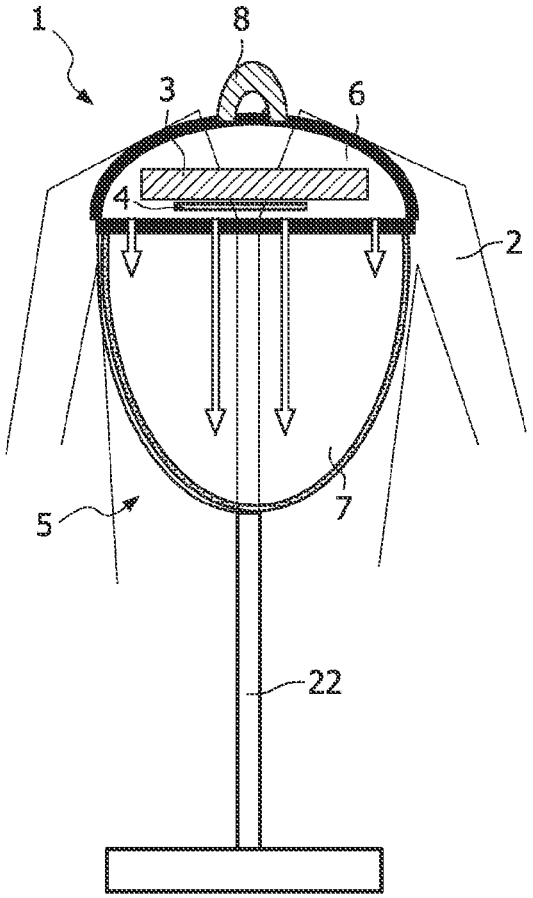
FIG. 8 shows an embodiment of the device according to the present invention which comprises a pedestal for allowing the device to stand on the ground.

It has been described in the foregoing that the garments refreshing device 1 may be equipped with a hook-shaped element 8 for hanging the device 1 from any suitable structure. However, it is also possible that the garments refreshing device 1 comprises means for attaching the device 1 to any suitable supporting surface such as a wall, or means for allowing the device 1 to stand on a substantially horizontal surface, i.e. for allowing the device 1 to stand on the ground. The possibilities as mentioned are illustrated in FIGS. 7 and 8. FIG. 7 shows how the garments refreshing device 1 may comprise a bar 20 or the like which is suitable to be used for attaching the device 1 to a wall, wherein any suitable means such as a fixing plate 21 may be arranged at a free end of the bar 20 in order to facilitate the attachment process. FIG. 8 shows how the garments refreshing device 1 may comprise a pedestal 22 for allowing the device 1 to stand on the ground.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

In the foregoing, a device 1 for refreshing garments 2 has been disclosed, which comprises means 5 for supporting a garment 2 and means 3 for generating an air flow at the location where a garment 2 is present when it is put in place on the supporting means 5. The supporting means 5 comprise two parts 6, 7 which are both suitable to be used for supporting a garment 2, and which are displaceably arranged with respect to each other. In this way, an enhanced functionality of the device 1 may be achieved in comparison with a device having supporting means which comprise only a single part.

In particular, it is possible to provide all of a refreshing air flow to an inside of a garment 2 if so desired, namely in a position of the supporting parts 6, 7 in which they are relatively close to each other. On the other hand, it is possible to provide a refreshing air flow in two parts, namely one part flowing through an inside of a garment 2, and one part flowing over the garment 2, at an outside of the garment 2, namely in a position of the supporting parts 6, 7 in which they are located further from each other, when the garment 2 is supported on another supporting part 7 than the supporting part 6 in which the air flow generating means 3 are arranged.

Furthermore, the garments refreshing device 1 having the two-part supporting body 5 may very well be used as a portable device which is easy to store, as the supporting body 5 may be made as small as possible for that purpose. On the other hand, due to the fact that the parts 6, 7 of the supporting body 5 may be displaced with respect to each other, the device 1 is suitable to be used for refreshing garments 2 of various sizes.

The invention claimed is:

1. Device for refreshing garments, comprising:

means for supporting a garment and means for generating an air flow at the location where a garment is present when it is put in place on the supporting means, wherein the supporting means is collapsible and comprises two parts which are both suitable to be used for supporting a garment, and which are displaceably arranged with respect to each other and wherein the means for generating an air flow at a location where the garment is present comprises an air flow generator and holes located in the supporting means.

2. Device according to claim 1, wherein the parts of the supporting means are adapted to assume a first mutual position in which they are arranged in an abutting fashion, and a second mutual position in which they are arranged at a distance with respect to each other.

3. Device according to claim 1, wherein the parts of the supporting means comprise engaging elements which are slideable with respect to each other, and which are adapted to allow for a linear movement of the parts with respect to each other and to guide such movement.

4. Device according to claim 3, wherein the engaging elements comprise at least one assembly of a shaft and a bush for encompassing and guiding the shaft, wherein each of the shaft and the bush of the assembly is arranged in another of the parts of the supporting means.

5. Device according to claim 1, wherein the air flow generating means are arranged in one of the parts of the supporting means, and wherein a functional side of the air flow generating means, i.e. a side where air is blown or sucked in during operation, is directed at the other part.

6. Device according to claim 1, further comprising a hook-shaped element for hanging the device.

7. Device according to claim 1, further comprising means for attaching the device to a supporting surface.

8. Device according to claim 1, further comprising means for allowing the device to stand on a substantially horizontal surface.

9. Device according to claim 1, further comprising at least one of means for supplying heat, means for supplying steam, means for ionizing air, means for supplying chemical products suitable for treating garments, means for generating ultrasonic sound, and means for adsorbing odor causing molecules.

10. Device according to claim 1, further comprising means for controlling the operation of the air flow generating means, wherein the controlling means are adapted to control the air flow generating means on the basis of a controlling scheme for letting the air flow generating means perform an air blowing operation during at least one period of time, and letting the air flow generating means perform an air sucking operation during at least one other period of time.

11. Device according to claim 1, further comprising means for controlling the operation of the air flow generating means, wherein the controlling means are adapted to control the air flow generating means on the basis of a controlling scheme for letting the air flow generating means cause an air flow in a first predetermined area during at least one period of time, and letting the air flow generating means cause an air flow in a second predetermined area, which is another area than the first predetermined area, during at least one other period of time.

12. Device according to claim 1, further comprising means for controlling the operation of the air flow generating means, wherein the controlling means are adapted to operate the air flow generating means during a predetermined period of time, and to terminate the operation of the air flow generating means as soon as the end of the predetermined period of time is reached.

13. Device according to claim 1, further comprising a battery which is adapted for providing the energy which is necessary for operating the device by powering at least the air flow generating means.

14. Device according to claim 7, wherein the supporting means is a wall.

15. Device according to claim 8, wherein the substantially horizontal surface is a pedestal.

16. Device according to claim 8, wherein the substantially horizontal surface is a stand.

* * * * *